US012343645B2

(12) United States Patent
Peloquin

(10) Patent No.: US 12,343,645 B2
(45) Date of Patent: Jul. 1, 2025

(54) PORTABLE GOLF GAME BOARD

(71) Applicant: Paul Peloquin, Amherstview (CA)

(72) Inventor: Paul Peloquin, Amherstview (CA)

( * ) Notice: Subject to any disclaimer, the term of this patent is extended or adjusted under 35 U.S.C. 154(b) by 405 days.

(21) Appl. No.: 17/841,560

(22) Filed: Jun. 15, 2022

(65) Prior Publication Data

US 2023/0405448 A1 Dec. 21, 2023

(51) Int. Cl.

| | |
|---|---|
| ***A63F 7/00*** | (2006.01) |
| ***A63F 7/06*** | (2006.01) |
| ***A63F 7/24*** | (2006.01) |

(52) U.S. Cl.

CPC ..... *A63F 7/0628* (2013.01); *A63F 7/24* (2013.01)

(58) Field of Classification Search

None

See application file for complete search history.

(56) References Cited

U.S. PATENT DOCUMENTS

| | | | | |
|---|---|---|---|---|
| 3,554,553 A * | 1/1971 | Hayashi | A63F 7/40 | 473/588 |
| 3,643,952 A * | 2/1972 | Sprowl | A63F 7/00 | 273/110 |
| 3,801,101 A * | 4/1974 | Greenberg | A63F 7/0628 | 273/125 R |
| 3,931,972 A * | 1/1976 | Fabian | A63F 7/386 | 273/110 |
| 5,213,325 A * | 5/1993 | Malavazos | A63F 7/386 | 273/109 |

* cited by examiner

*Primary Examiner* — Sunit Pandya

(74) *Attorney, Agent, or Firm* — CAPEHART LAW FIRM

(57) ABSTRACT

A portable golf game board includes a board, a playing surface, a golf ball, at least one first handle and at least one second handle. The playing surface represents a realistic golf course with simulated water hazards, trees, bunkers, greens, tees, etc. A golf ball is rolled onto the playing surface and, using the at least one first handle and the at least one second handle attached at either end of the board, players move the board to direct the golf ball from a tee section on the board to a hole on the board whilst trying to avoid various hazards.

19 Claims, 6 Drawing Sheets

PORTABLE GOLF GAME BOARD

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of golf games of existing art and more specifically relates to a portable game simulating a game of golf.

RELATED ART

Golf is a game generally played on a golf course that consists of a series of 'holes' having one or more tee-off boxes, a fairway, a green having a hole therein, and a variety of hazards such as ponds, rivers, sand bunkers, trees, etc. The object of the game is to get a golf ball from a tee-off box into the hole on the green in as little strokes as possible. Players must navigate through the fairway and try to avoid the variety of hazards that are positioned in between the tee-off box and the hole.

Golf is and has been a hugely popular sport for hundreds of years. However, there are circumstances in which it is difficult to play golf. For example, golf is typically played outdoors, and as such, the ability to play is dependent on the weather conditions that day. Further, for some individuals, their access to golf courses is limited. This can be due to their location, finances, weather conditions, etc. As such, it would be desirable to provide a portable game that simulates a game of golf and is playable by any individual in a variety of locations.

SUMMARY OF THE INVENTION

In view of the foregoing disadvantages inherent in the known golf game art, the present disclosure provides a novel portable golf game board. The general purpose of the present disclosure, which will be described subsequently in greater detail, is to provide a game including realistic features of a golf course and providing one or more players with an alternative to playing a game of golf on a golf course.

A portable golf game is disclosed herein. The portable golf game may include a board, a playing surface, a golf ball for rolling about the playing surface, at least one first handle and at least one second handle. The board may include a top side opposite a bottom side, a first side opposite a second side and a first end opposite a second end. The playing surface may be disposed on the top side of the board. The playing surface may represent a golf course and may include at least one hole, at least one tee section and at least one hazard. The at least one first handle may be attached about the first end of the board and the at least one second handle may be attached about the second end of the board, opposite the at least one first handle. The at least one first handle and the at least one second handle may provide at least one user with a means of moving the board, thereby moving the golf ball about the playing surface and directing it from the at least one tee section to the at least one hole.

According to another embodiment, a method of playing a portable golf game is also disclosed herein. The method may include the steps of: providing the portable golf game as above wherein the at least one hole includes at least three holes and the at least one tee section includes at least three tee sections; placing the golf ball at a first tee section of the at least three tee sections, thereby beginning a round; grasping, by at least a first player, one of the at least one first handle and the at least one second handle; moving the board, via at least the one of the at least one first handle and the at least one second handle, thereby directing the golf ball from the first tee section, about the playing surface and into a first hole of the at least three holes; placing the golf ball at a second tee section of the at least three tee sections; grasping, by at least the first player, the one of the at least one first handle and the at least one second handle; moving the board, via at least the one of the at least one first handle and the at least one second handle, thereby directing the golf ball from the second tee section, about the playing surface and into a second hole of the at least three holes; placing the golf ball at a third tee section of the at least three tee sections; grasping, by at least the first player, the one of the at least one first handle and the at least one second handle; and moving the board, via at least the one of the at least one first handle and the at least one second handle, thereby directing the golf ball from the third tee section, about the playing surface and into a third hole of the at least three holes, which then may, in some embodiments, complete the round.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a portable golf game board, constructed and operative according to the teachings of the present disclosure.

The various embodiments of the present invention will hereinafter be described in conjunction with the appended drawings, wherein like designations denote like elements.

DETAILED DESCRIPTION

Figure 1:
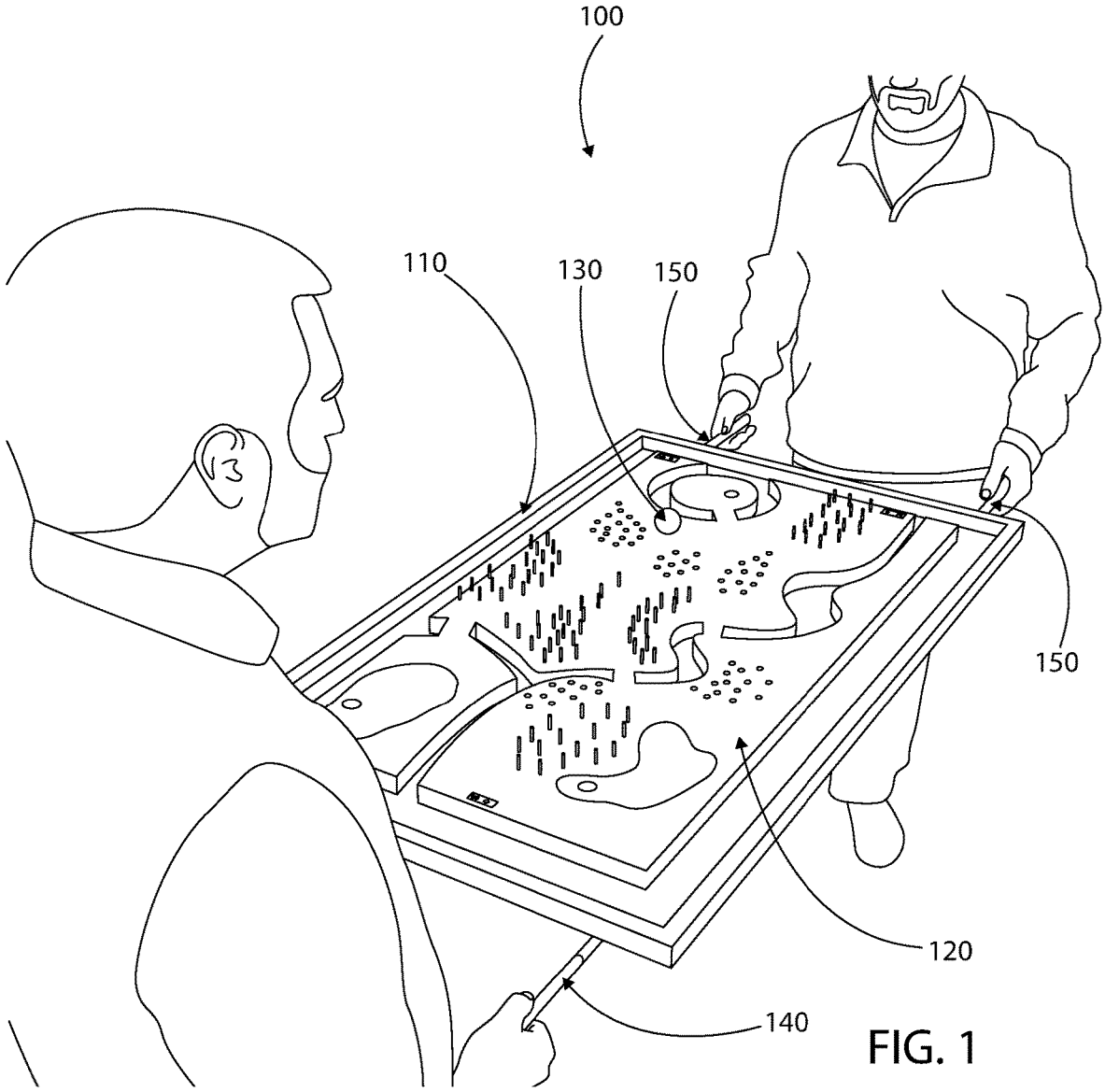
FIG. 1 is a perspective view of the portable golf game being played by two players, according to an embodiment of the disclosure.

As discussed above, embodiments of the present disclosure relate to golf games and more particularly to a portable golf game board. Generally, the portable golf game board may include a board including realistic fairways with simulated water hazards, trees, bunkers, and/or the like. A golf ball may be rolled onto the board and, using handles attached at either end of the board, players may move the board to direct the golf ball from a tee section on the board to a hole on the board by following the fairway and trying to avoid trees, bunkers, water and out of bounds areas. Winning may be measured not by strokes, as in a real game of golf, but in a time it takes to complete the 'course' on the portable golf game board.

Referring now more specifically to the drawings by numerals of reference, there is shown in FIGS. 1-6, various views of a portable golf game 100. As shown in these figures, the portable golf game 100 may include a board 110, a playing surface 120, a golf ball 130, at least one first handle 140 and at least one second handle 150. As discussed above, the portable golf game 100 may represent an actual golf course having imitation greens, tee-off sections, holes and hazards.

The board 110 may include a top side 111 opposite a bottom side 112, a first side 113 (i.e., a left side) opposite a second side 114 (i.e., a right side) and a first end 115 (i.e., a front end) opposite a second end 116 (i.e., a rear end). The playing surface 120 may be disposed on the top side 111 of the board 110 and, as above, may represent an actual golf course. For example, the playing surface 120 may offer a rollable surface for which a golf ball 130 (FIG. 1) is able to roll thereon and may particularly include at least one hole 121, at least one tee section 122 and at least one hazard 123. As shown in these figures, the playing surface 120 may also include at least one imitation green 124 on which the at least one hole 121 is located, again, as in a real golf course. A remaining portion of the playing surface 120 may represent an actual golf course fairway.

Figure 2:
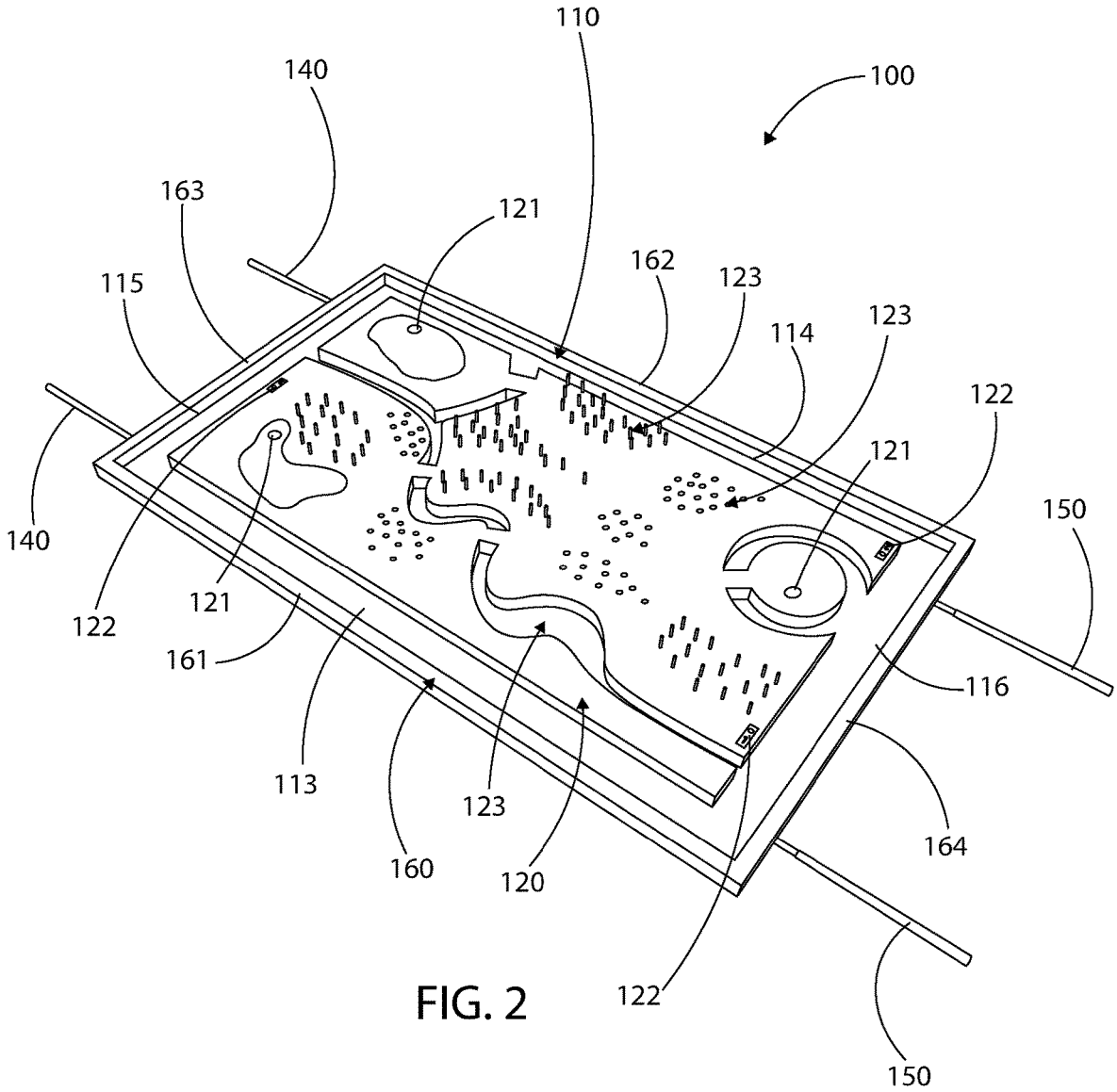
FIG. 2 is a side perspective view of the portable golf game, according to an embodiment of the present disclosure.
Figure 3:
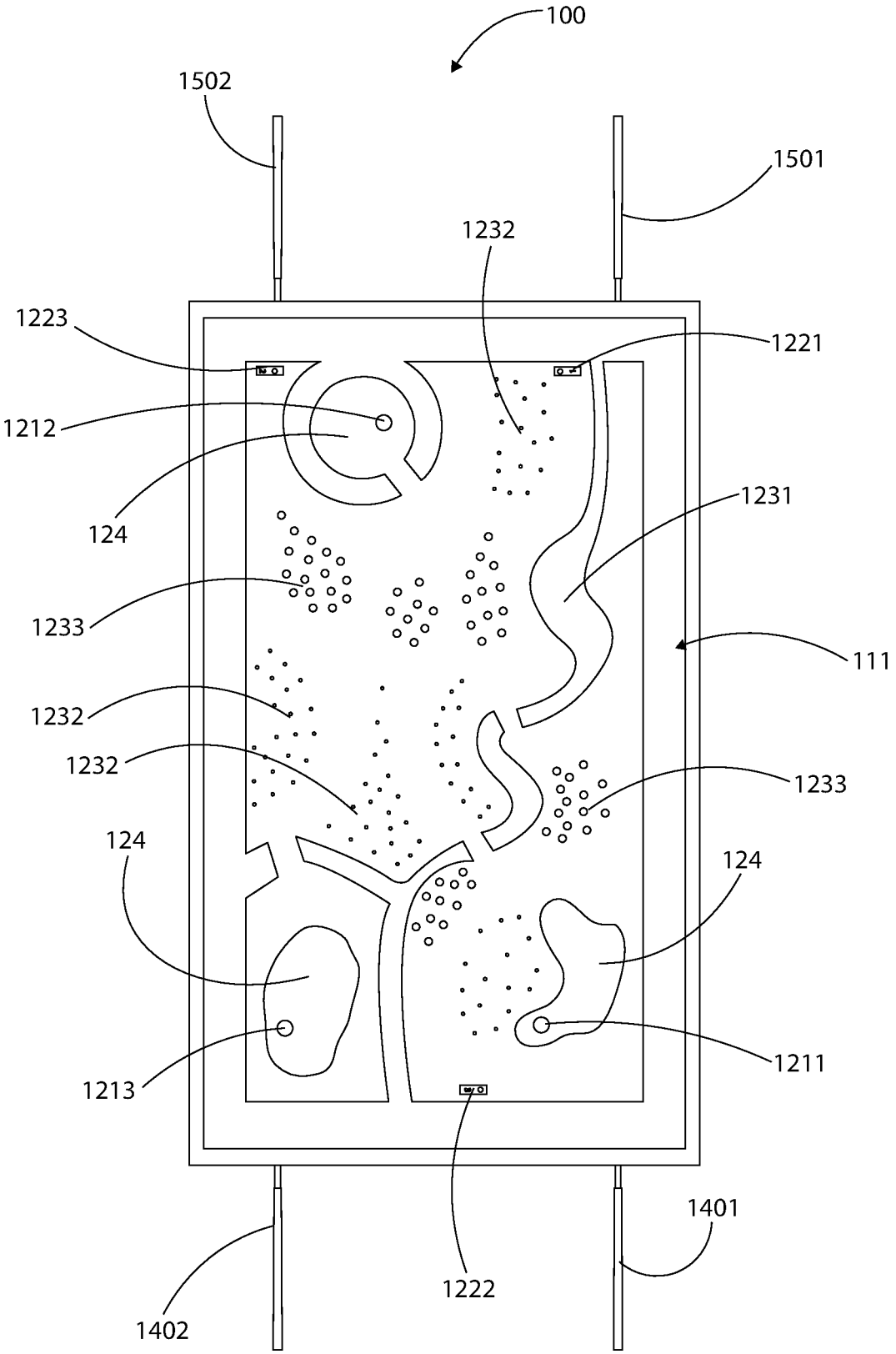
FIG. 3 is a top view of the portable golf game, according to an embodiment of the present disclosure.

In some embodiments, the at least one hole 121 may include a physical hole, or cavity, extending into the playing surface 120. In other embodiments, the at least one hole 121 may include a circular demarcation that does not extend into the playing surface 120. Further, as shown in FIGS. 1-3, the at least one tee section 122 may include a ball support section to support the golf ball 130 thereon, as with an actual tee. In addition, in some embodiments, the playing surface 120 may include different textures to represent an actual golf course terrain. For example, the at least one imitation green 124 may include a smoother surface than the rest of the playing surface 120, simulating a difference between an actual golf course green and an actual golf course fairway.

Figure 4:
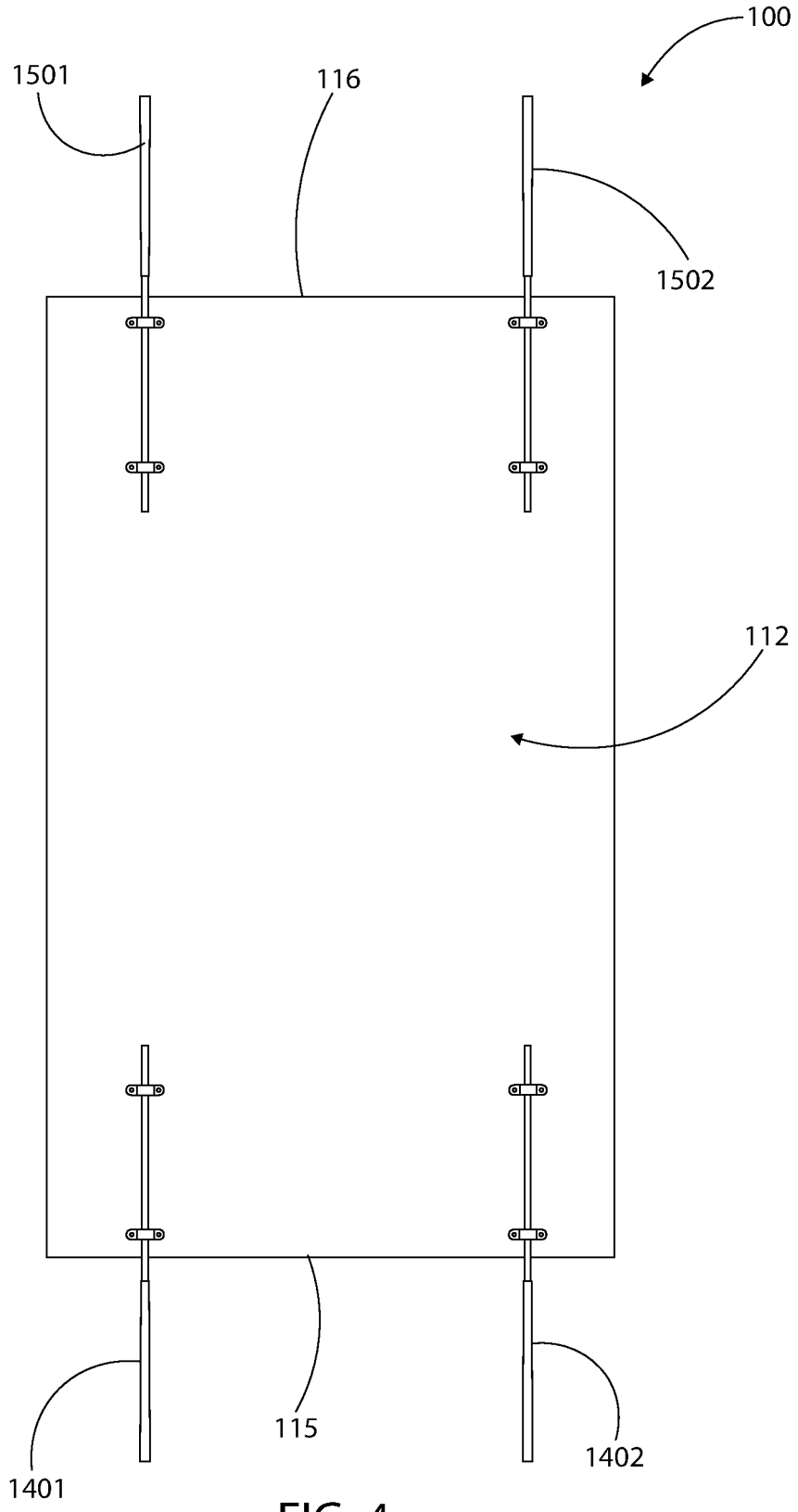
FIG. 4 is a bottom view of the portable golf game, according to an embodiment of the present disclosure.
Figure 5:
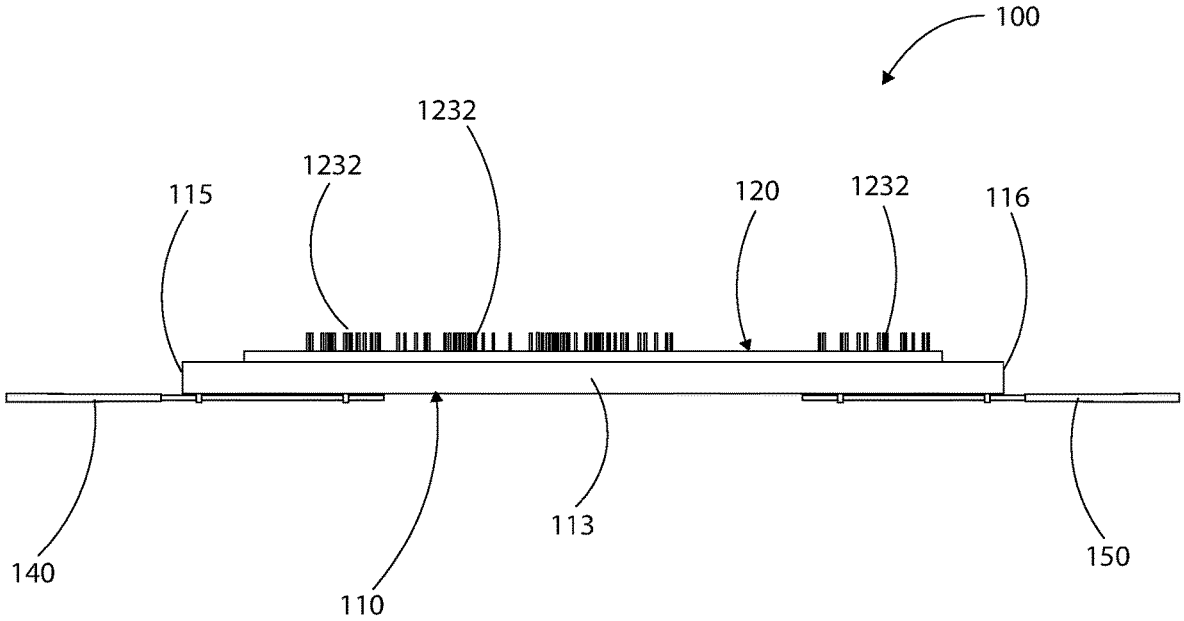
FIG. 5 is a side view of the portable golf game, according to an embodiment of the present disclosure.
Figure 6:
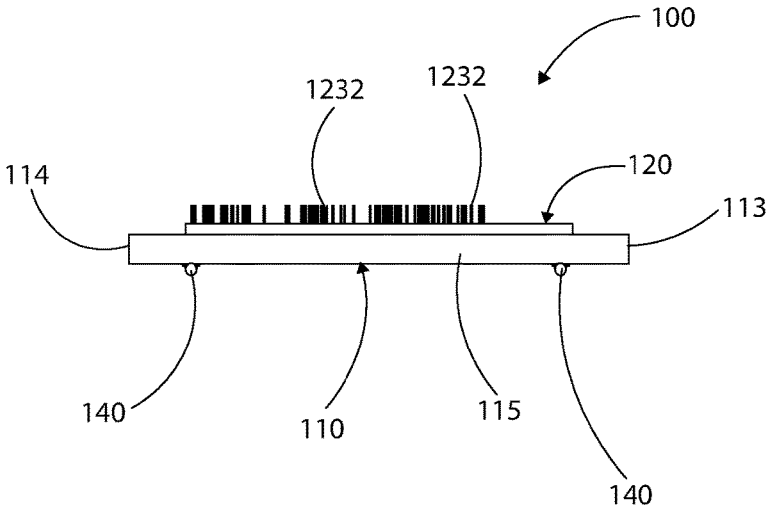
FIG. 6 is a front view of the portable golf game, according to an embodiment of the present disclosure.

As shown in FIGS. 1-5, the at least one first handle 140 may be attached at the first end 115 of the board 110, and the at least one second handle 150 may be attached at the second end 116 of the board 110 and opposite the at least one first handle 140. Particularly, as shown in FIG. 4, the at least one first handle 140 and the at least one second handle 150 may be attached to the bottom side 112 of the board 110. The at least one first handle 140 and the at least one second handle 150 may provide at least one player with a means of moving the board 110, thereby moving the golf ball 130 about the playing surface 120 and directing it from the at least one tee section 122 to the at least one hole 121.

In some examples, the portable golf game 100 may be played in teams of one or more working against each other to complete a round in the least amount of time; in other examples players may all work together. Preferably, the portable golf game 100 may be played by between 1-4 players. As such, the at least one first handle 140 and the at least one second handle 150 may accommodate 1-4 players. For example, if playing solo, a player may simply grasp one of the at least one first handle 140 or the at least one second handle 150 to move the board 110. Further, when playing solo, the portable golf game 100 may further include a center leg (not illustrated) attached to the bottom side 112 of the board 110. For example, the center leg may either be removably attached to the bottom side 112 or may fold out from the bottom side 112 of the board 110. To play with two players, a first player may grasp one of the at least one first handle 140 or the at least one second handle 150 and a second player may grasp the other one of the at least one first handle 140 or the at least one second handle 150 (at an opposite end of the board 110 than the first player).

To aid in play with four players, the at least one first handle 140 may include a pair of first handles 1401, 1402 and the at least one second handle 150 may include a pair of second handles 1501, 1502. In this embodiment, in one example, the first player may grasp one of the pair of first handles (i.e., 1401) the second player may grasp one of the pair of second handles (i.e., 1501), a third player may grasp another one of the pair of first handles (i.e., 1402) and a fourth player may grasp another one of the pair of second handles (i.e., 1502). As such, in this example, the first player and the third player may be at the first end 115 of the board 110; and the second player and the fourth player may be at the second end 116 of the board 110.

For play with one or two players in this embodiment, each player may grasp both handles on a particular end 115, 116 of the board 110. For example, when playing solo, a player may grasp either both of the pair of first handles 1401, 1402 or both of the pair of second handles 1501, 1502. When playing with two players, one of the players may grasp both of the pair of first handles 1401, 1402; and another player may grasp both of the pair of second handles 1501, 1502.

As discussed above, the object of the portable golf game 100 is for the player(s) to move the board 110 (via the at least one first handle 140 and/or the at least one second handle 150) to move the golf ball 130 from the at least one tee section 122 to the at least one hole 121, whilst avoiding the at least one hazard 123 and trying to prevent the golf ball 130 from falling off of the board 110, in the least amount of time. Again, as above, the portable golf game 100 may replicate a realistic game of golf. As such, as shown, the playing surface 120 may include multiple holes 121 and tee sections 122 such that the player(s) may complete multiple holes 121 in one round.

For example, as shown in FIGS. 1-3, the at least one hole 121 may include at least three holes 121 located at different positions on the playing surface 120 and the at least one tee section 122 may include at least three tee sections 122 located at different positions on the playing surface 120. Further, the at least one imitation green 124 may include at least three imitation greens 124 and each of the at least three holes 121 may be located on one of the imitation greens 124. To play the portable golf game 100 in this embodiment, the player(s) may begin a round at a first tee section 1221 of the at least three tee sections 122, and move the board 110 to move the golf ball 130 into a first hole 1211 of the at least three holes 121; the player(s) then may move the golf ball 130 to a second tee section 1222 and move the board 110 to move the golf ball 130 into a second hole 1212; finally, the player(s) may move the golf ball 130 to a third tee section 1223 and move the golf ball 130 into a third hole 1213. This may complete the round. However, it should be appreciated that the playing surface 120 is not limited to three tee sections 122 or three holes 121 and as such, it should be appreciated that, in some embodiments, the round may not be completed at the third hole 1213.

As shown in FIGS. 1-3, at least one hole 121 may be located about either the first end 115 or the second end 116 of the board 110 and the at least one tee section 122 may be located about another of the first end 115 or the second end 116 of the board 110, with the plurality of hazards 123 located therebetween. In embodiments including more than one hole 121 and more than one tee section 122, the first tee section 1221 may be located at one of the ends (i.e., 115) and the first hole 1211 may be located opposite it at another one of the ends (i.e., 116), the second tee section 1222 may be located at one of the ends (i.e., 116) and the second hole 1212 may be located opposite it at another one of the ends (i.e., 115), and so on.

To increase a difficulty of play, the at least one hazard 123 may include a plurality of hazards 123. Again, the hazards 123 may resemble actual hazards 123 typical on actual golf courses. For example, as shown in these figures, the plurality of hazards 123 may include (but are not limited to) at least one imitation water hazard 1231, a plurality of imitation tree hazards 1232 and a plurality of imitation bunker hazards 1233. As shown, the plurality of hazards 123 may be spaced about the playing surface 120 between the at least one tee section 122 and the at least one hole 121 and configured to obstruct or otherwise hinder movement of the golf ball 130 across the playing surface 120.

As shown, the at least one imitation water hazard 1231 may include a cavity extending into the playing surface 120. In some embodiments, the at least one imitation water hazard 1231 may represent a river hazard. As such, the cavity may be an elongated narrow cavity. In some embodiments, as shown, the at least one imitation water hazard 1231 may include 'bridges' defined by the playing surface 120 which allow the golf ball 130 to cross the at least one imitation water hazard 1231. The at least one imitation water hazard 1231 may be sized to receive the golf ball 130, thus if the golf ball 130 falls into the at least one imitation water hazard 1231 the golf ball 130 is unable to get back onto the playing surface 120 (without the player(s) stopping play and physically removing the golf ball 130 from the at least one imitation water hazard 1231).

The plurality of imitation tree hazards 1232 may include clusters of trees, or forest areas, located around various areas of the playing surface 120. The plurality of imitation tree hazards 1232 may each include a long thin body that extends upwardly (vertically) from the playing surface 120 and resembles a tree. The clusters, or forest areas, may thus act as obstructions for the golf ball 130, preventing the golf ball 130 from passing therethrough and forcing the player(s) to move the golf ball 130 therearound, which may cause the golf ball 130 to fall into another hazard 123 or off of the board 110. As shown in FIGS. 1-3, the plurality of imitation bunker hazards 1233 may also be located around various areas of the playing surface 120. The plurality of imitation bunker hazards 1233 may include depressions extending into the playing surface 120, to resemble real sand bunkers, and acting as another hindrance for the golf ball 130.

Further, another 'hazard' associated with the play of the portable golf game 100 may be the sides 113, 114 and the ends 115, 116 of the board 110, in that movement of the board 110 may cause the golf ball 130 to fall off the playing surface 120 (and off the board 110). As such, the board 110 may further include an out of bounds catch area 160 disposed around a periphery thereof, preventing the golf ball 130 from falling to a ground if it falls from the playing surface 120 (and thereby causing an unnecessary stall in the play). Particularly, the out of bounds catch area 160 may include a first side panel 161 attached at the first side 113 of the board 110; a second side panel 162 attached at the second side 114 of the board 110; a first end panel 163 attached at the first end 115 of the board 110; and a second end panel 164 attached at the second end 116 of the board 110.

In some embodiments, at least a portion of the playing surface 120 may be interchangeable. For example, the tee section(s) 122, the hole(s) 121, the hazard(s) 123, etc. may be removed, replaced and/or relocated, thereby enabling different playing surface 120 designs, different orientations, different features, etc. This may permit the addition of replicas of real life golf courses, allowing a user to personalize the portable golf game 100.

Figure 7:
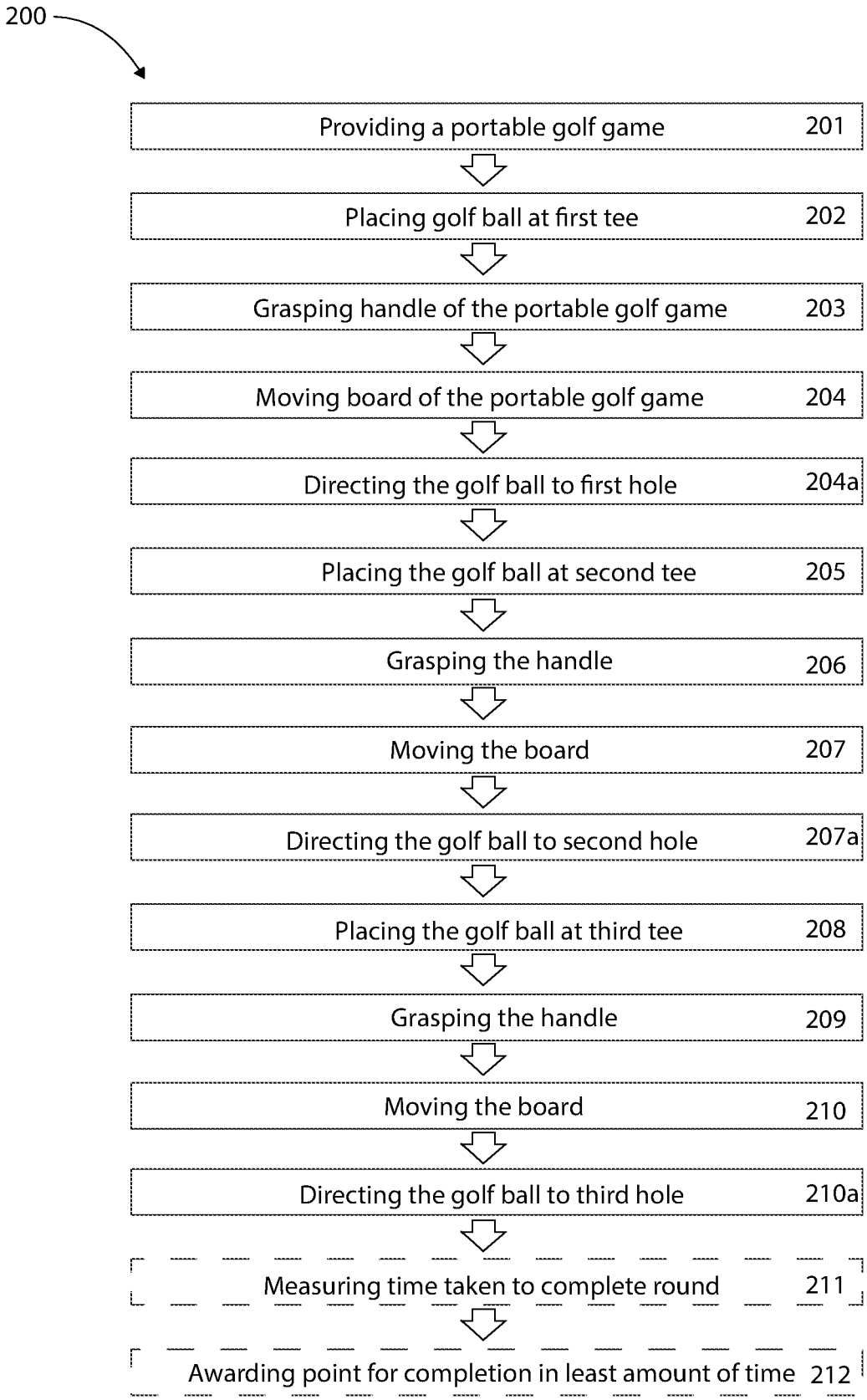
FIG. 7 is a flow diagram illustrating a method of playing a portable golf game, according to an embodiment of the present disclosure.

Referring now to FIG. 7 showing a flow diagram illustrating a method of playing a portable golf game 200 according to an embodiment of the present disclosure. In particular, the method 200 may include one or more components or features of the portable golf game 100 as described above. As illustrated, the method 200 may include the steps of: step one 201, providing the portable golf game; step two 202, placing the golf ball at a first tee section of the at least three tee sections, thereby beginning a round; step three 203, grasping, by at least a first player, one of the at least one first handle and the at least one second handle; step 204, moving the board, via at least the one of the at least one first handle and the at least one second handle, thereby directing 204*a* the golf ball from the first tee section, about the playing surface and into a first hole of the at least three holes; step five 205, placing the golf ball at a second tee section of the at least three tee sections; step six 206, grasping, by at least the first player, the one of the at least one first handle and the at least one second handle; step seven 207, moving the board, via at least the one of the at least one first handle and the at least one second handle, thereby directing 207*a* the golf ball from the second tee section, about the playing surface and into a second hole of the at least three holes; step eight 208, placing the golf ball at a third tee section of the at least three tee sections; step nine 209, grasping, by at least the first player, the one of the at least one first handle and the at least one second handle; step ten 210, moving the board, via at least the one of the at least one first handle and the at least one second handle, thereby directing 210*a* the golf ball from the third tee section, about the playing surface and into a third hole of the at least three holes. Thereby, in some embodiments, completing the round. However, again as above, the portable golf game 100 is not limited to three holes and as such the round is not limited to being completed at the third hole.

Further, as discussed above, who wins the portable golf game may be determined by the time it takes to complete the round, rather than strokes. As such, as shown in FIG. 7, the method 200 may further comprise the steps of: step eleven 211, measuring an amount of time taken to complete the round; and step twelve 212, awarding at least one point to a player (or team) who completes the round in the least amount of time.

It should be noted that certain steps are optional steps and may not be implemented in all cases. Optional steps of method 200 are illustrated using dotted lines in FIG. 7 so as to distinguish them from the other steps of method 200. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for playing a portable golf game are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. A portable golf game comprising:

a board including a top side opposite a bottom side, a first side opposite a second side and a first end opposite a second end;

a playing surface disposed on the top side of the board, the playing surface representing a golf course and including at least one hole, at least one tee section, and at least one hazard;

a golf ball for rolling about the playing surface;

at least one first handle attached about the first end of the board; and at least one second handle attached about the second end of the board and opposite the at least one first handle; and wherein the at least one first handle and the at least one second handle provide at least one user with a means of moving the board, thereby moving the golf ball about the playing surface and directing it from the at least one tee section to the at least one hole, wherein the board further includes an out of bounds catch area disposed around a periphery thereof.

2. The portable golf game of claim 1, wherein the at least one first handle and the at least one second handle are attached to the bottom side of the board.

3. The portable golf game of claim 2, wherein the at least one first handle includes a pair of first handles and wherein the at least one second handle includes a pair of second handles.

4. The portable golf game of claim 1, wherein the at least one hole is located about one of the first end and the second end of the board and wherein the at least one tee section is located about another one of the first end and the second end of the board.

5. The portable golf game of claim 4, wherein the at least one hazard includes at least one of at least one imitation water hazard, a plurality of imitation tree hazards, and a plurality of imitation bunker hazards.

6. The portable golf game of claim 5, wherein the at least one tee section includes at least three tee sections each located at different positions on the playing surface.

7. The portable golf game of claim 6, wherein the at least one hole includes at least three holes each located at different positions on the playing surface.

8. The portable golf game of claim 7, wherein at least a portion of the playing surface is interchangeable.

9. The portable golf game of claim 8, wherein the playing surface further includes at least three imitation greens and wherein each one of the three holes are located on one of the at least three imitation greens.

10. A method of playing a portable golf game comprising the steps of:

providing the portable golf game including:

a board including a top side opposite a bottom side, a first side opposite a second side and a first end opposite a second end;

a playing surface disposed on the top side of the board, the playing surface representing a golf course and including at least three holes each located at different positions on the playing surface, at least three tee sections each located at different positions on the playing surface, and at least one hazard;

a golf ball for rolling about the playing surface;

at least one first handle attached about the first end of the board; and at least one second handle attached at the second end of the board and opposite the at least one first handle; and placing the golf ball at a first tee section of the at least three tee sections, thereby beginning a round;

grasping, by at least a first player, one of the at least one first handle and the at least one second handle;

moving the board, via at least the one of the at least one first handle and the at least one second handle, thereby:

directing the golf ball from the first tee section, about the playing surface and into a first hole of the at least three holes;

placing the golf ball at a second tee section of the at least three tee sections;

grasping, by at least the first player, the one of the at least one first handle and the at least one second handle;

moving the board, via at least the one of the at least one first handle and the at least one second handle, thereby:

directing the golf ball from the second tee section, about the playing surface and into a second hole of the at least three holes;

placing the golf ball at a third tee section of the at least three tee sections;

grasping, by at least the first player, the one of the at least one first handle and the at least one second handle; and moving the board, via at least the one of the at least one first handle and the at least one second handle, thereby:

directing the golf ball from the third tee section, about the playing surface and into a third hole of the at least three holes.

11. The method of claim 10, wherein the portable golf game is played with between 1-4 players.

12. The method of claim 10, further comprising the steps of:

measuring an amount of time taken to complete the round; and awarding at least one point to a player who completes the round in the least amount of time.

13. The method of claim 12, wherein the at least one hazard includes at least one of at least one imitation water hazard, a plurality of imitation tree hazards and a plurality of imitation bunker hazards.

14. The method of claim 13, wherein the board further includes an out of bounds catch area disposed around a periphery thereof.

15. A portable golf game comprising:

a board including a top side opposite a bottom side, a first side opposite a second side and a first end opposite a second end;

a playing surface disposed on the top side of the board, the playing surface representing a golf course and including at least three greens, at least three holes each located on one of the at least three greens at different positions on the playing surface, at least three tee sections each located at different positions on the playing surface, and a plurality of hazards including at least one imitation water hazard, a plurality of imitation tree hazards, and a plurality of imitation bunker hazards;

a golf ball for rolling about the playing surface;

at least one first handle attached about the first end of the board; and at least one second handle attached about the second end of the board and opposite the at least one first handle; and wherein the at least one first handle and the at least one second handle provide at least one user with a means of moving the board, thereby moving the golf ball about the playing surface and directing it from the at least one tee section to the at least one hole.

16. The portable golf game of claim 15, wherein at least a portion of the playing surface is interchangeable.

17. The portable golf game of claim 16, wherein the board further includes an out of bounds catch area disposed around a periphery thereof.

18. The portable golf game of claim 15, wherein the at least one first handle and the at least one second handle are attached to the bottom side of the board.

19. The portable golf game of claim 18, wherein the at least one first handle includes a pair of first handles and wherein the at least one second handle includes a pair of second handles.

* * * * *